US011121506B2

(12) United States Patent
Feng et al.

(10) Patent No.: US 11,121,506 B2
(45) Date of Patent: Sep. 14, 2021

(54) GROUNDING SHEET AND CONNECTOR

(71) Applicant: KEMAX SHING CO., LTD., New Taipei (TW)

(72) Inventors: Chih-Kuo Feng, New Taipei (TW); Ya-Hui Hsu, New Taipei (TW)

(73) Assignee: KEMAX SHING CO., LTD., New Taipei (TW)

( * ) Notice: Subject to any disclaimer, the term of this patent is extended or adjusted under 35 U.S.C. 154(b) by 0 days.

(21) Appl. No.: 16/898,622

(22) Filed: Jun. 11, 2020

(65) Prior Publication Data

US 2021/0218193 A1 Jul. 15, 2021

(30) Foreign Application Priority Data

Jan. 10, 2020 (TW) ..... 109200450

(51) Int. Cl.
*H01R 13/6581* (2011.01)
*H01R 12/72* (2011.01)

(52) U.S. Cl.
CPC ..... *H01R 13/6581* (2013.01); *H01R 12/721* (2013.01)

(58) Field of Classification Search
CPC .. H01R 13/646; H01R 13/6486; H01R 13/02; H01R 13/42; H01R 13/6581; H01R 13/648; H01R 12/721; H01R 12/72
USPC ..... 439/607.01
See application file for complete search history.

(56) References Cited

U.S. PATENT DOCUMENTS 5,124,889 A * 6/1992 Humbert ..... H04B 15/02 174/354
6,315,616 B1 * 11/2001 Hayashi ..... H01R 12/89 439/638
6,890,193 B2 * 5/2005 Kimura ..... H01R 23/6873 439/108
7,029,330 B1 * 4/2006 Ro ..... H01R 13/443 439/148
7,297,025 B2 * 11/2007 Wei ..... H01R 13/6594 439/607.04
7,300,312 B1 * 11/2007 Chen ..... H01R 13/6594 439/607.31
7,320,623 B2 * 1/2008 Hisamatsu ..... H01R 13/6485 439/108
7,771,232 B2 * 8/2010 Si ..... H01R 13/658 439/607.01

(Continued)

*Primary Examiner* — Peter G Leigh
(74) *Attorney, Agent, or Firm* — Demian K. Jackson; Jackson IPG PLLC

(57) ABSTRACT

A grounding sheet having a body and elastic conduction sheets is provided. The elastic conduction sheet has a first elastic sheet and a second elastic sheet, each of the first elastic sheet and the second elastic sheet a closed terminal, a floating arm, a connection arm, at least one free terminal and at least one end terminal, wherein the closed terminal is connected to the body of the grounding sheet, the connection arm is connected to the closed terminal and the floating arm, the free terminal is connected to the floating arm, and the end terminal is connected to the free terminal and corresponds to the floating arm. The first elastic sheet has the merely one free terminal, and the second elastic sheet has the two free terminals and the two end terminals. The connector using the same can quickly conduct noise outside.

13 Claims, 15 Drawing Sheets

(56) References Cited

U.S. PATENT DOCUMENTS

| | | | | |
|---|---|---|---|---|
| 8,337,249 | B2 * | 12/2012 | Lappoehn | H01R 13/6585 439/607.55 |
| 8,636,543 | B2 * | 1/2014 | McNamara | H01R 13/6461 439/607.07 |
| 8,727,809 | B2 * | 5/2014 | Mongold | H01R 13/6585 439/607.14 |
| 8,851,922 | B2 * | 10/2014 | Miyazaki | H01R 13/648 439/497 |
| 9,130,313 | B2 * | 9/2015 | Mongold | H01R 12/721 |
| 9,270,067 | B2 * | 2/2016 | Lin | H01R 31/06 |
| 9,306,339 | B2 * | 4/2016 | Hasegawa | H01R 13/646 |
| 9,401,570 | B2 * | 7/2016 | Phillips | H01R 13/6583 |
| 9,478,924 | B2 * | 10/2016 | Tamai | H01R 13/6473 |
| 9,653,849 | B2 * | 5/2017 | Hsu | H01R 13/6584 |
| 9,716,326 | B2 * | 7/2017 | Tamai | H01R 12/73 |
| 2008/0096423 | A1 * | 4/2008 | Huang | H01R 12/716 439/607.05 |
| 2019/0190212 | A1 * | 6/2019 | Fang | H01R 13/646 |

* cited by examiner

GROUNDING SHEET AND CONNECTOR

TECHNICAL FIELD

The present disclosure relates to a high frequency connector device, and in particular to a grounding sheet and a connector having the at least one grounding sheet integrated therein, wherein the connector is capable of conducting noise outside quickly by using elastic conduction sheets of the grounding sheet.

RELATED ART

Common electronic products, such as mobile phones, cameras, computers, computer peripherals (such as display cards, memory cards) and other 3C supplies, have become indispensable tools for everyone's life.

A variety of electronic products use a connector in order to transfer data or charge. It can be understood that the connector is a bridge for signal communication of electronic products. If the quality of the connector is poor, it is easy to cause signal delay, or short circuit, or even cause electronic product failure.

For this reason, major foreign and domestic manufacturers are actively developing new connectors, and are expected to develop connectors with small sizes, fast responses, fast transmission speeds, and noise eliminations.

After observing the connectors of various domestic and foreign manufacturers, it is found that due to the high transmission speed and high transmission frequency of the electronic products, the signals generated by the connectors will also be distorted during transmission. In order to solve this problem, a grounding sheet and a female terminal of the connector are connected to each other, and the noise is quickly conducted outside. However, the grounding sheet is separately corresponding to and contacts a terminal part, and then the noise is conducted outside. Therefore, it will naturally affect the high frequency transmission and high transmission speed. When the transmission speed is reduced, the transmission quality will be naturally affected.

How to solve the above problem(s) is an issue actively considered by related industrials.

SUMMARY

An objective of the present disclosure is to solve the above deficiency, a main feature of the present disclosure is to serially connect the grounding sheet with the terminal parts, wherein the grounding sheet has free terminals which terminal parts contacts. Thus, the grounding sheet can incorporate to quickly conduct the noise outside.

To achieve the above objective, the present disclosure provides a grounding sheet, and the grounding unit comprises a body and elastic conduction sheets being connected to the body. The elastic conduction sheet comprises a first elastic sheet and a second elastic sheet, and each of the first elastic sheet and the second elastic sheet has a closed terminal, a floating arm, a connection arm, at least one free terminal and at least one end terminal, wherein the closed terminal is connected to the body of the grounding sheet, the connection arm is connected to the closed terminal and the floating arm, the free terminal is connected to the floating arm, and the end terminal is connected to the free terminal and corresponds to the floating arm. The first elastic sheet has the merely one free terminal, and the second elastic sheet has the two free terminals and the two end terminals. The two free terminals of the second elastic sheet form a concave part therebetween. The closed terminal of the second elastic sheet and the connection arm of the second elastic sheet are connected at a first connection part, the first connection part and the concave part have a second elastic sheet length therebetween, and the second elastic sheet length is 1.840 mm.

In one embodiment of the present disclosure, each of the two end terminals of the second elastic sheet has a middle point, and the two middle points have a middle point distance being 1.000 mm therebetween.

In one embodiment of the present disclosure, the body has an elastic grounding sheet surface; the elastic grounding sheet surface and an outer wall of each of the floating arms have a first angle therebetween, the first angle is 15.75 degrees, the end terminal of each of the elastic conduction sheet and an inner wall of the floating arm have a second angle therebetween, and the second angle is 18 degrees.

In one embodiment of the present disclosure, the elastic grounding sheet surface and the inner wall of the floating arm have a third angle therebetween, and the third angle is larger than or equal to 0 degrees and less than or equal to 45 degrees.

In one embodiment of the present disclosure, the third angle of the second elastic sheet is 30.83 degrees, and a top part of the free terminal and the elastic grounding sheet surface have a second elastic sheet distance being 1.104 mm therebetween.

In one embodiment of the present disclosure, a first elastic sheet width of the first elastic sheet is 0.300 mm.

In one embodiment of the present disclosure, the first connection part and a bottom of the end terminal have a first elastic sheet length being 2.333 mm therebetween.

In one embodiment of the present disclosure, the closed terminal of the first elastic sheet and the body are connected at a second connection part, and the second connection part and the first connection part have a closed terminal length being 0.298 mm therebetween.

In one embodiment of the present disclosure, the concave part of the second elastic sheet and the bottom of the end terminal have an end terminal length being 0.565 mm therebetween.

In one embodiment of the present disclosure, the two end terminals of the second elastic sheet have a nearest end terminal width being 0.700 mm therebetween.

In one embodiment of the present disclosure, the grounding sheet is integrally formed by one metal sheet, such as a gold sheet, a silver sheet, a copper sheet, a nickel sheet or a tin sheet.

The present disclosure provides a connector, and the connector comprises a plastic housing having opened terminals and an inserting hole, terminal parts installed in the plastic housing and the at least one grounding sheet mentioned above. Each of the terminal parts comprises an arc contacting portion and a welding portion, the arc contacting portion and the welding portion are connected to each other, and a signal transmission path is formed from the arc contacting portion to the welding portion. The at least one grounding sheet is disposed in the plastic housing and corresponds to the opened terminal. The body is located on the plastic housing, the first elastic sheet and the second elastic sheet extends through the opened terminal to contact the terminal parts, and the first elastic sheet and the second elastic sheet contacts terminal part at a contacting part being located at a middle point of the signal transmission path.

In one embodiment of the present disclosure, a front side and a rear side of the plastic housing have the opened terminals.

In one embodiment of the present disclosure, the plastic housing is used for a connection interface of PCI-E.

In one embodiment of the present disclosure, the opened terminal has convex parts corresponding to the concave parts.

In one embodiment of the present disclosure, an object, such as a memory car, display car or a network card can insert into the connector via the inserting hole.

According the features of the present disclosure, the technical results obtained are illustrated as follows.

1. The grounding sheet is integrated in one connector, the elastic conduction sheets can have different sizes based on different communication protocols, the elastic conduction sheets contacts the terminal parts, and when the terminal parts receive and transmit signals, the elastic conduction sheets can be used to quickly conduct the noise outside, thus obtaining high signal transmission speed and stable signal transmission quality.

2. The structure and installation of the connector and grounding sheet are simple, and when the grounding sheet is installed in the plastic housing, the elastic conduction sheet contacts the terminal parts (i.e. not like the installation the conventional structure, each grounding sheet should be separately installed), thus increasing the installation efficiency.

BRIEF DESCRIPTIONS OF DRAWINGS

DETAILS OF EXEMPLARY EMBODIMENTS

Figure 1:
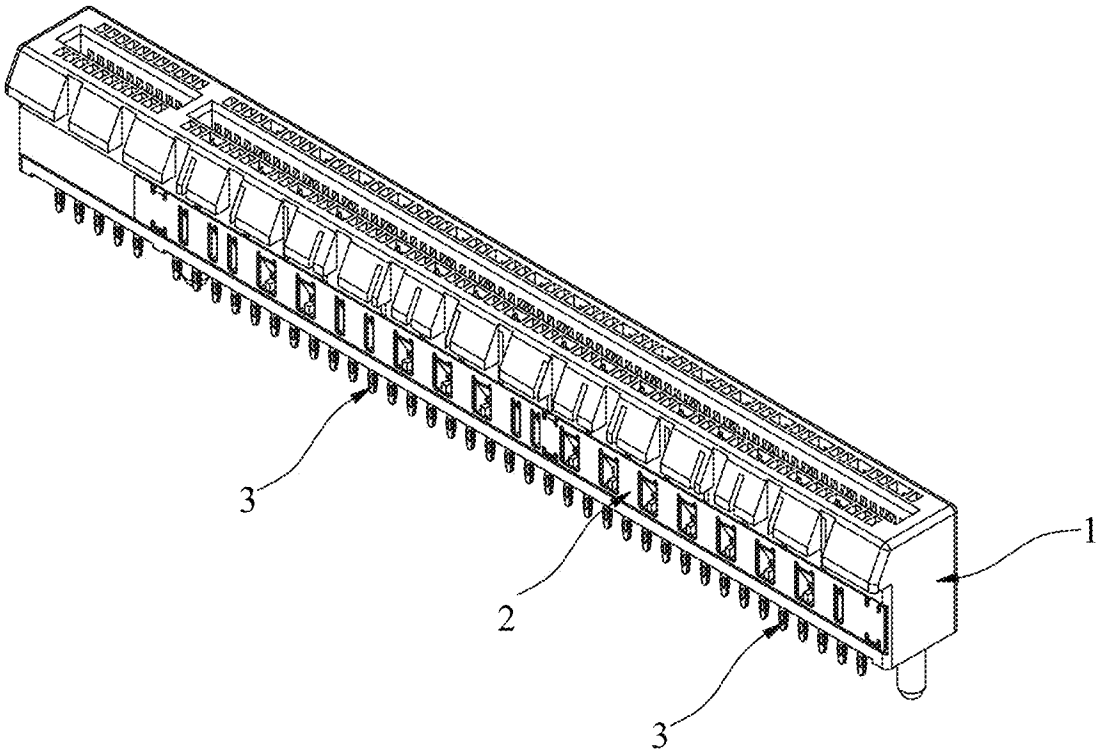
FIG. 1 is a three dimensional structure diagram of a connector of the present disclosure.

Referring to FIG. 1, the connector at least comprises a plastic housing (1), two sets of grounding sheets (2) and terminal parts (3). The connector of the present disclosure can be a high frequency connector, and specifically applied to a device with PCI-E (Peripheral Component Interconnect Express) bus. In the present disclosure, it is noted that the tolerance of angles can be ±0.02 degrees.

Figure 2:
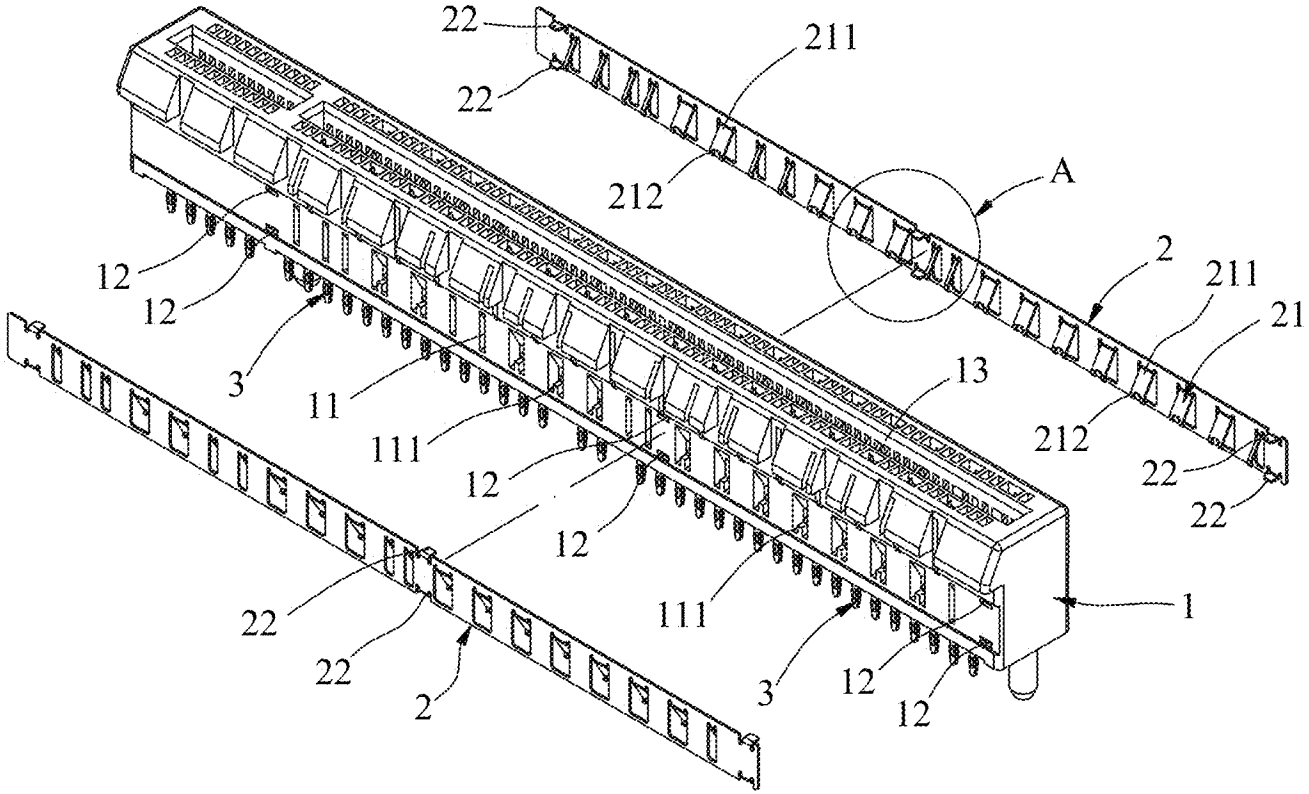
FIG. 2 is an explosive structure diagram of a connector of the present disclosure.
Figure 3:
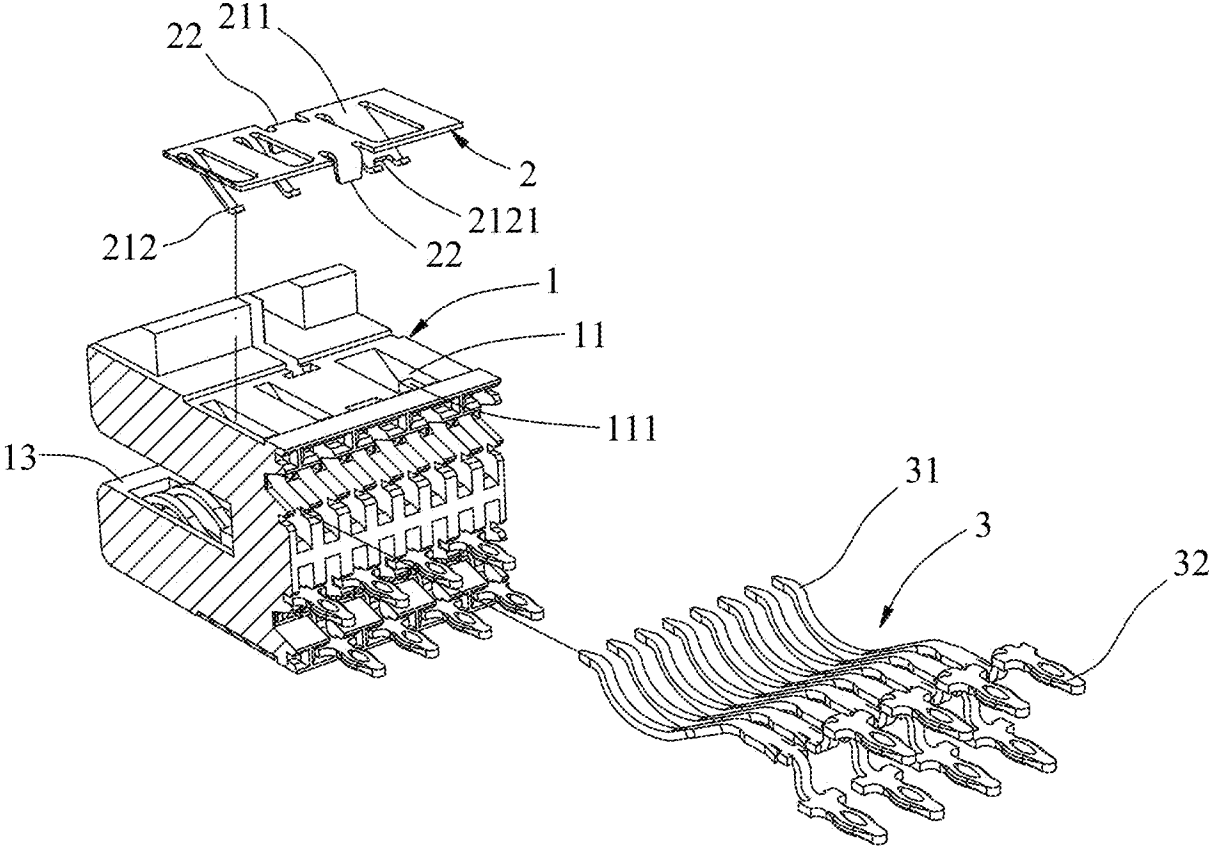
FIG. 3 is a schematic diagram showing a connection of the plastic housing and the terminal parts.

Due to the complexity of the connector of the present disclosure, it is necessary to refer to a plurality of drawings at the same time to facilitate description and understanding. Therefore, when referring to the implementation of this specification, please refer to the corresponding labeled number in FIG. 1 through FIG. 12 at the same time. Firstly, referring to FIG. 2, the plastic housing (1) is provided to the terminal parts (3), and the terminal parts (3) can be installed in the plastic housing (1). The plastic housing (1) has opened terminals (11) corresponding to positions of the grounding sheets (2), and the plastic housing (1) has sockets (12). Referring to FIG. 3, the top of the plastic housing (1) is opened to form an inserting hole (13), and the inserting hole (13) is provided to an object (not shown in drawings) which can be inserted into the connector via the inserting hole (13). An arc contacting portion (31) on the top of the terminal part (3) can contact the object, so as to transfer a signal, and the object can be a memory card, a display card or a network card. The terminal part (3) has a welding portion (32), and the arc contacting portion (31) is connected to the welding portion (32). The terminal part (3) can be welded on a circuit board (not shown in drawings) via the welding portion (32). The signal can be transmitted from the arc contacting portion (31) to the welding portion (32), and then to the circuit board, such that a signal transmission path is formed from the arc contacting portion (31) to the welding portion (32). In the embodiment, the length of the signal transmission path is 8.675 mm (millimeter). The operating principles of plastic housing (1) and terminal part (3) are not much different from conventional connectors, so the redundant descriptions are omitted. As shown in FIG. 2, the opened terminals (11) are formed on a front side and a rear side of the plastic housing, and connected to two corresponding grounding sheets (2).

Referring to FIG. 4 through FIG. 8, the grounding sheet (2) comprises a body (2A) and elastic conduction sheets (21), the elastic conduction sheet (21) is connected to the body (2A), the body (2A) is disposed on an outer side surface of the plastic housing (1), the elastic conduction sheet (21) extends to the plastic housing (1) via the opened terminal (11), the grounding sheet (2) further has connection terminals (22) corresponding to the sockets (12), and the grounding sheet (2) is combined with the plastic housing (1).

Figure 7:
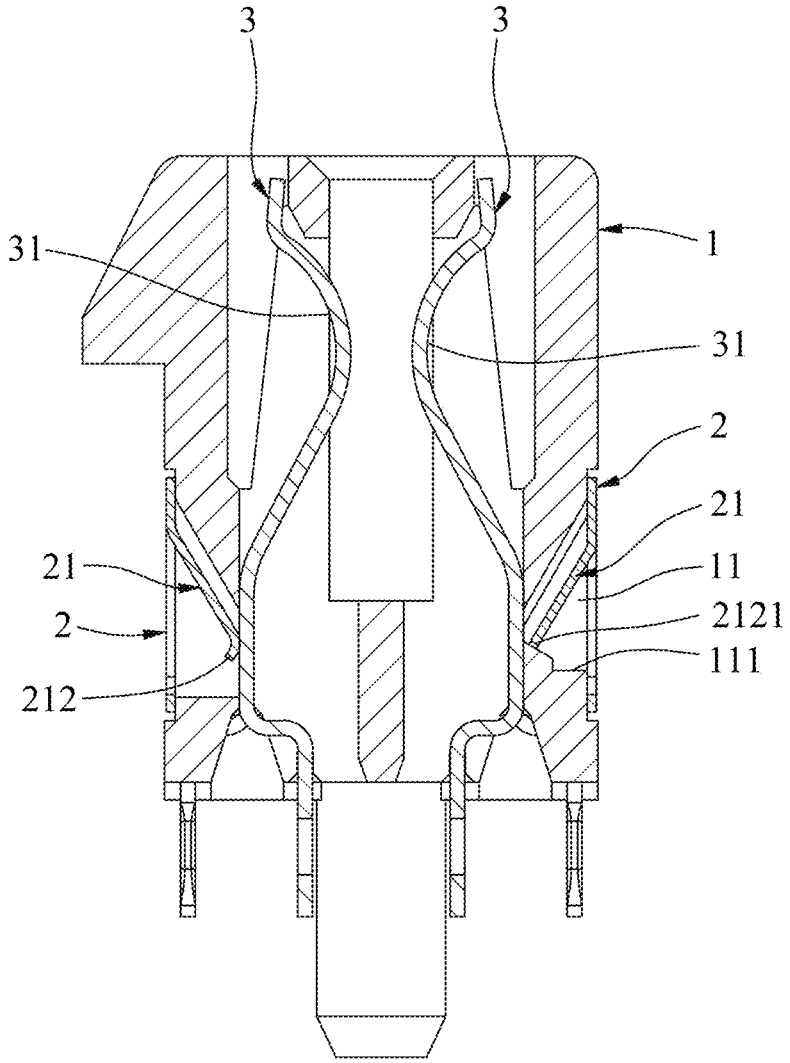
FIG. 7 is a sectional view of a section line 7-7 in FIG. 6.
Figure 8:
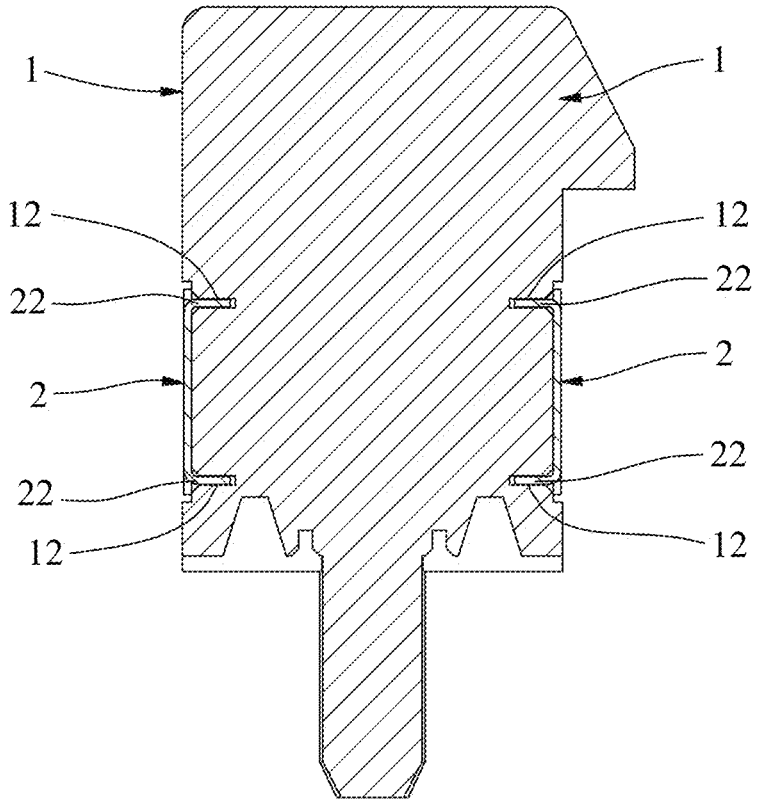
FIG. 8 is a sectional view of a section line 8-8 in FIG. 6.
Figure 9:
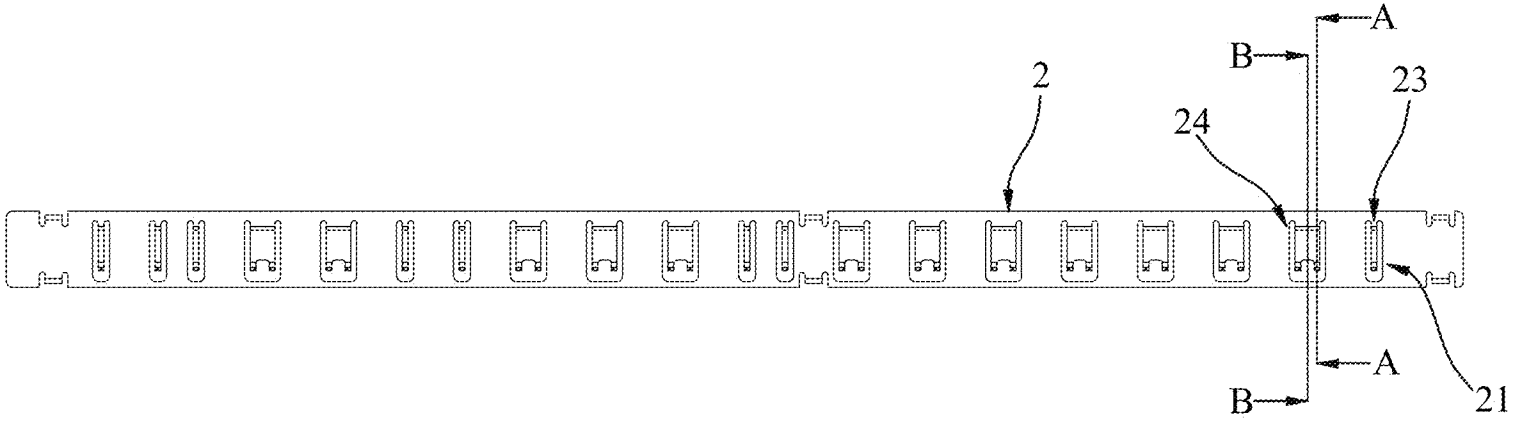
FIG. 9 is a schematic diagram of a grounding sheet.

Referring to FIG. 9 through FIG. 12, the elastic conduction sheets (21) comprise a first elastic sheet (23) and a second elastic sheet (24). Each of the first elastic sheet (23) and the second elastic sheet (24) has a closed terminal (211), a floating arm (217), a connection arm (213), at least one free terminal (212) and at least one end terminal (214). The closed terminal (211) is connected to the body (2A) of the grounding sheet (2), and the connection arm (213) is connected to the closed terminal (211) and the floating arm (217). The free terminal (212) is installed in the opened terminal (11) and contacts the terminal part (3), and the free terminal (212) is connected to the floating arm (217). The end terminal (214) is connected to the free terminal (212) and corresponds to the floating arm (217). The first elastic sheet (23) has the merely one free terminal (212). The second elastic sheet (24) has the two free terminals (212) and the two end terminals (214). The two free terminals of the second elastic sheet (24) form a concave part (2121) therebetween. As shown in FIG. 7, the position which the free terminal (212) contacts the terminal part (3) is preferred to be the middle point of the above signal transmission path.

Figure 10:
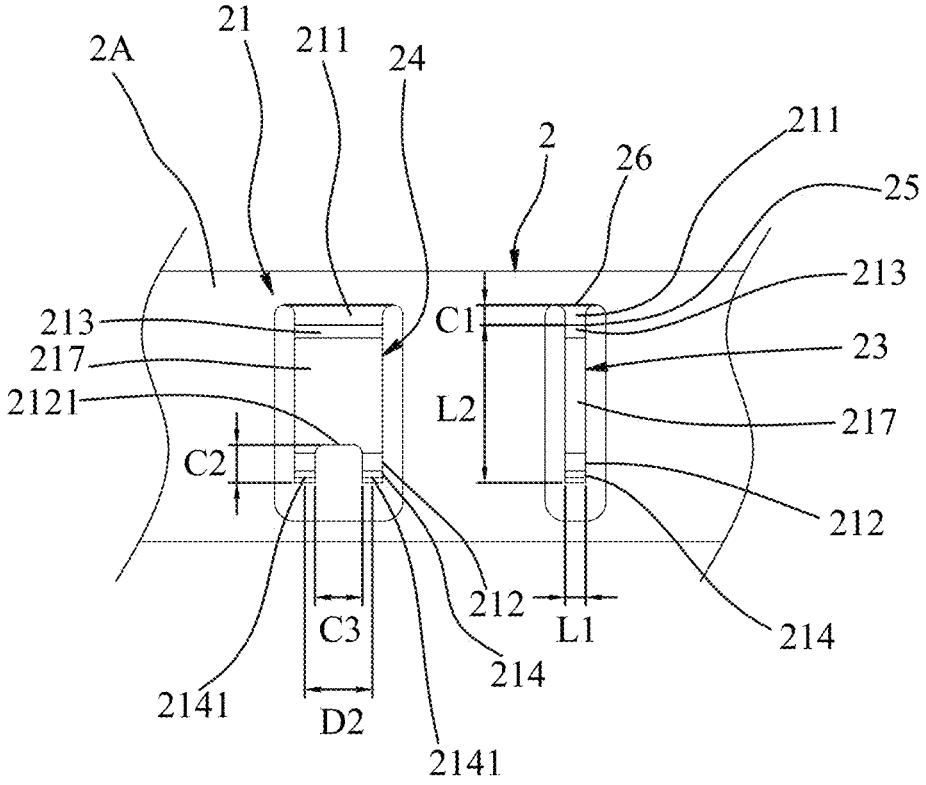
FIG. 10 is an enlarged schematic diagram of a portion of the grounding sheet.
Figure 11:
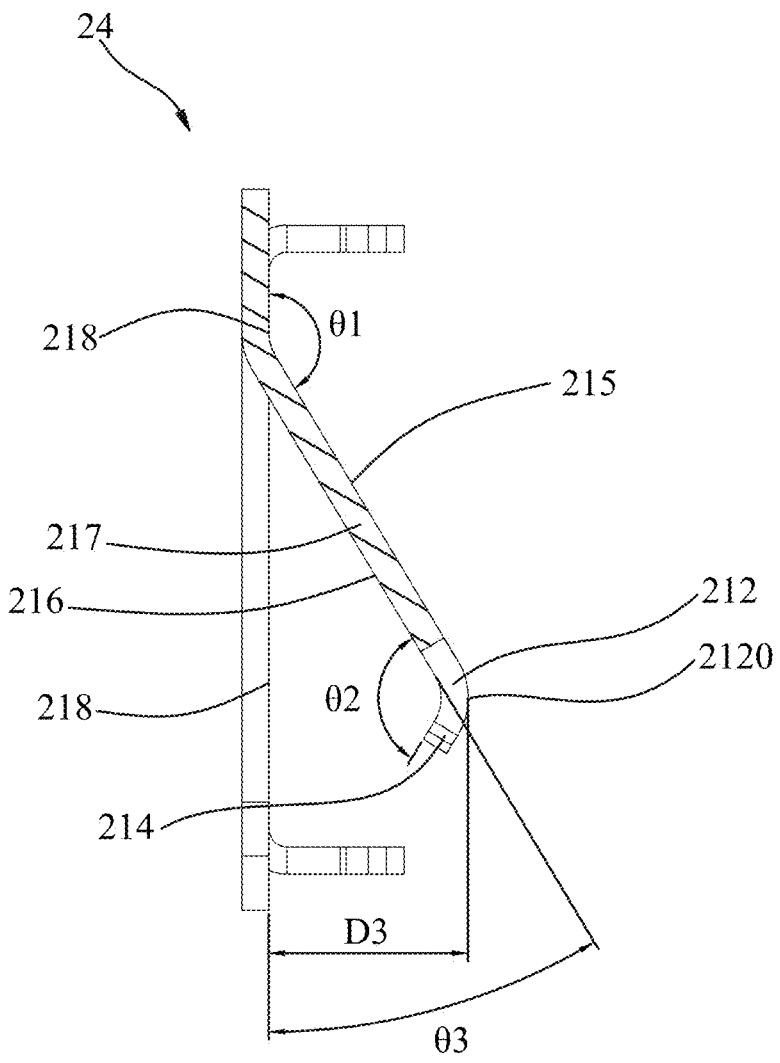
FIG. 11 is a sectional view of a section line A-A in FIG. 9.
Figure 12:
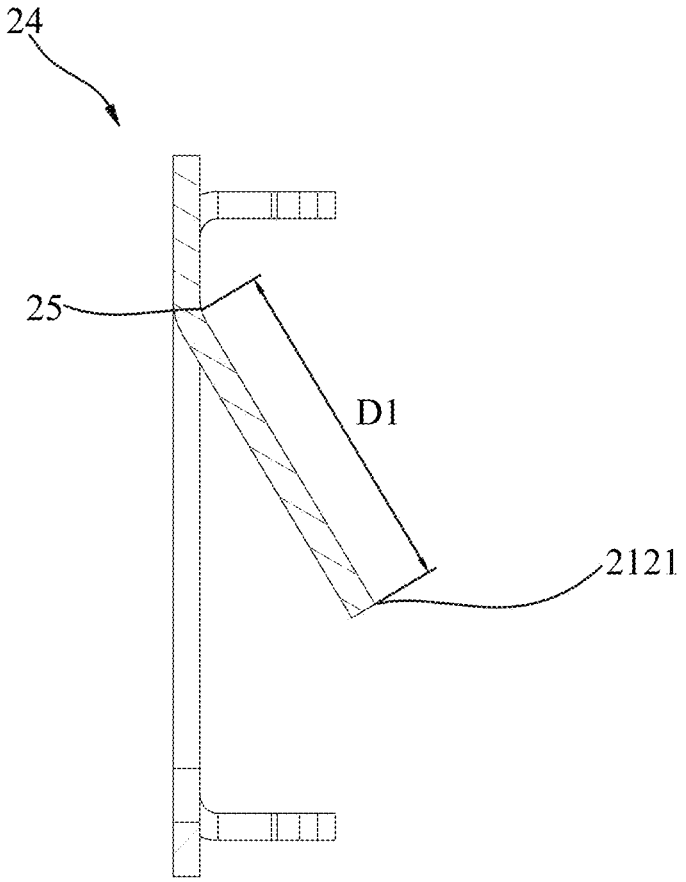
FIG. 12 is a sectional view of a section line B-B in FIG. 9.

When the connection arm (213) of the elastic conduction sheet (21) acts as an axis to make the free terminal (212) depart away from the body (2A) of the grounding sheet (2), a first connection part (25) and the concave part (2121) have a second elastic sheet length (D1) being 1.840 mm therebetween, wherein the closed terminal (211) of the second elastic sheet (24) and the connection arm (213) are connected at the first connection part (25), as shown in FIG. 12. Each of the two end terminals (214) of the second elastic sheet (24) has one middle point (2141), and the two middle points (2141) have a middle point distance (D2) being 1.000 mm therebetween. The middle point (2141) is a center point of the end terminal (214), as shown in FIG. 10. Referring to FIG. 11, one side of the grounding sheet (2) opposite to the elastic conduction sheets (21) has an elastic grounding sheet surface (218), and the elastic grounding sheet surface (218) and an outer wall (215) of each of the floating arms (217) have a first angle (01) being 15.75 degrees therebetween. The end terminal (214) of each of the elastic conduction sheets (21) and an inner wall (216) of the floating arm (217) have a second angle (02) being 18 degrees therebetween. The elastic grounding sheet surface (218) and the inner wall (216) of the floating arm (217) have a third angle (03) therebetween. By designing the lengths and widths of the first elastic sheet (23) and the second elastic sheet (24) to be fixed values, high frequency attenuation due to resonance of the grounding sheet (2) can be eliminated.

In an embodiment of the present disclosure, when the third angle (03) is 30.83 degrees, a top part (2120) the free terminal (212) and the elastic grounding sheet surface (218) have a second elastic sheet distance (D3) being 1.104 mm therebetween. The top part (2120) is the farthest part of the free terminal (212) along the vertical line of the elastic grounding sheet surface (218). Referring to FIG. 10, in an embodiment of the present disclosure, when the third angle (03) of the first elastic sheet (23) is 0 degrees, a first elastic sheet width (L1) of the first elastic sheet (23) is 0.300 mm. Further, when the third angle (03) of the first elastic sheet (23) is 0 degrees, the first connection part (25) and the bottom of the end terminal (214) have a first elastic sheet length (L2) being 2.333 mm therebetween. Or alternatively, when the third angle (03) of the first elastic sheet (23) is 0 degrees, a second connection part (26) and the first connection part (25) have a closed terminal length (C1) being 0.298 mm therebetween, wherein the closed terminal (211) of the first elastic sheet (23) and the body (2A) of the grounding sheet (2) are connected at the second connection part (26). In an embodiment of the present disclosure, the concave part (2121) of the second elastic sheet (24) and the bottom of the end terminal (214) have an end terminal length (C2) being 0.565 mm therebetween. The two end terminals (214) of the second elastic sheet (24) have a nearest end terminal width (C3) being 0.700 mm therebetween. By designing the lengths and widths of the first elastic sheet (23) and the second elastic sheet (24) to be fixed values, high frequency attenuation due to resonance of the grounding sheet (2) can be eliminated.

It is noted that, the grounding sheet (2) is integrally formed by one metal sheet, such as a gold sheet, a silver sheet, a copper sheet, a nickel sheet or a tin sheet. The present disclosure integrates grounding sheets (2) of all communication protocols in one connector. Referring to FIG. 2, FIG. 4, FIG. 5 and FIG. 7, the plastic housing (1) has opened terminals (11) corresponding to the positions of the elastic conduction sheets (21). The elastic conduction sheet (21) is tilted and comprises a closed terminal (211) and the free terminal (212), wherein the closed terminal (211) is connected to the body (2A) of the grounding sheet (2), and the free terminal (212) is installed in the opened terminal (11) and contacts the terminal part (3). The elastic conduction sheet (21) departs away from the grounding sheet (2) to obtain elasticity when the closed terminal (211) acts as an axis. Thus, when the grounding sheet (2) is combined with the plastic housing (1), the free terminal (212) contacts the terminal part (3) and the contacting position is slightly adjusted, the signal can be transferred, and the noise can be conducted outside.

As shown in FIG. 2 and FIG. 4 through FIG. 8, in addition to the elastic conduction sheet (21) connected to the plastic housing (1), the grounding sheet (2) is provided with several connection terminals (22) corresponding to the sockets (12), and the grounding sheet (2) is combined with the plastic housing (1) so as to make the plastic housing (1) and the grounding sheet (2) be not separated.

Figure 4:
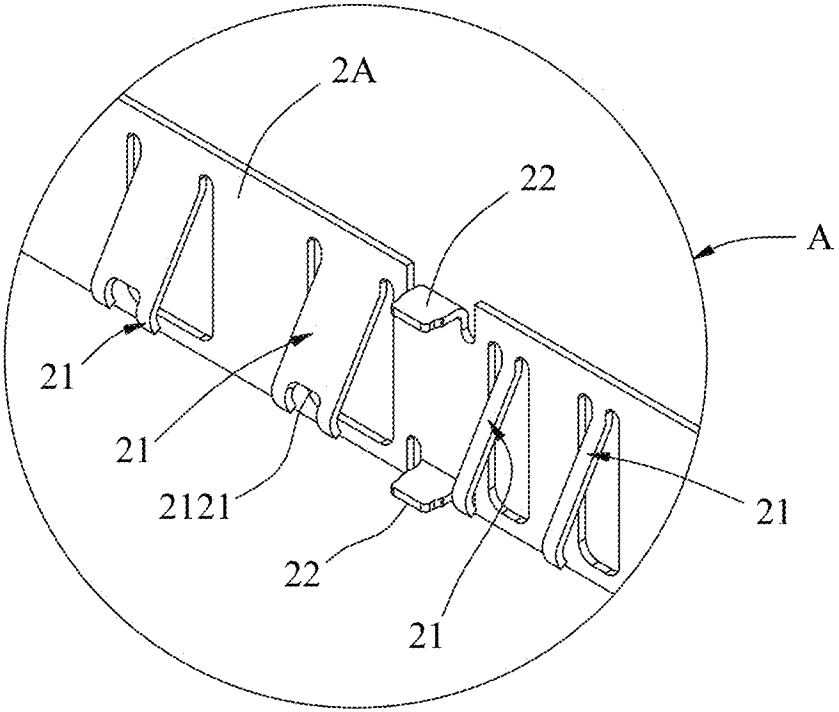
FIG. 4 is an enlarged schematic diagram of portion A in FIG. 2.
Figure 5:
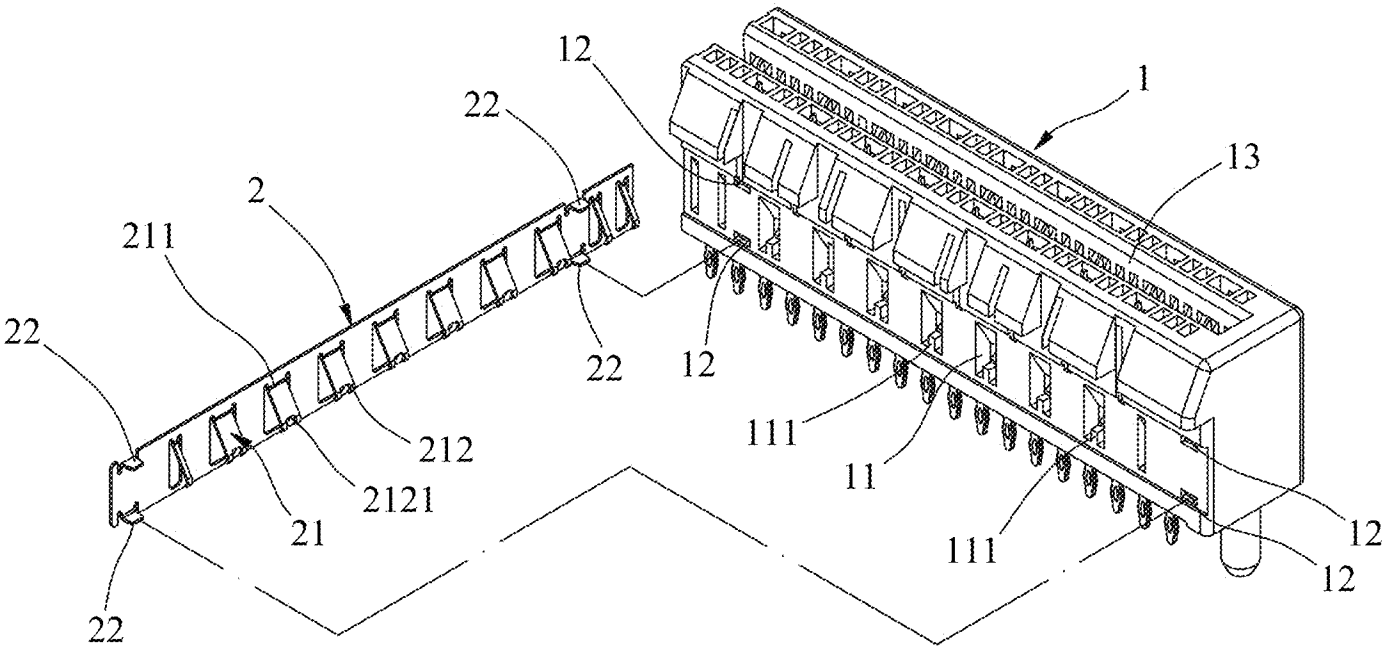
FIG. 5 is a schematic diagram showing a connection of the grounding sheet and plastic housing.
Figure 6:
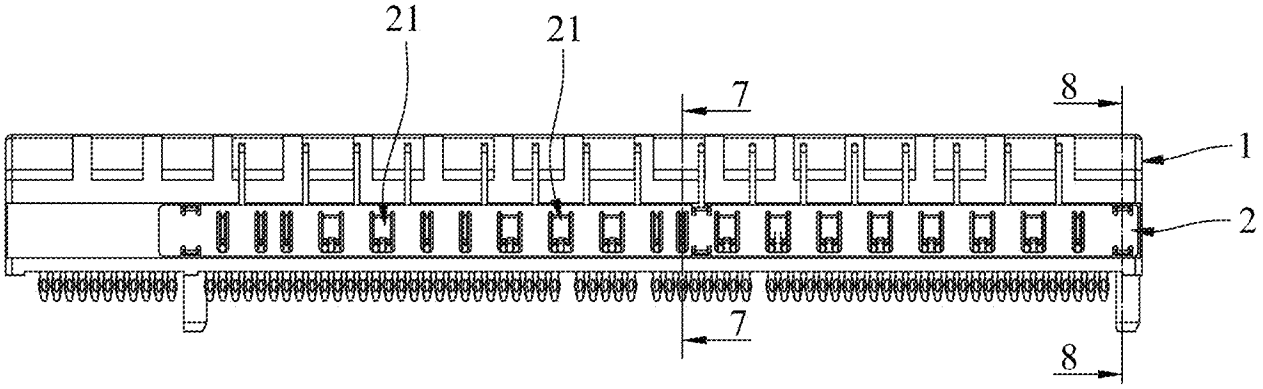
FIG. 6 is a front view of a connector of the present disclosure.

As shown in FIG. 1, FIG. 4 and FIG. 5, in order to provide better positioning and prevent the free terminal (212) from not touching the terminal part (3), the opened terminal (11) of the plastic housing (1) is provided with convex parts (111) corresponding to the concave parts (2121). Thus, the elastic conduction sheet (21) can contact the terminal part (3) to transmit the signal.

Figure 13:
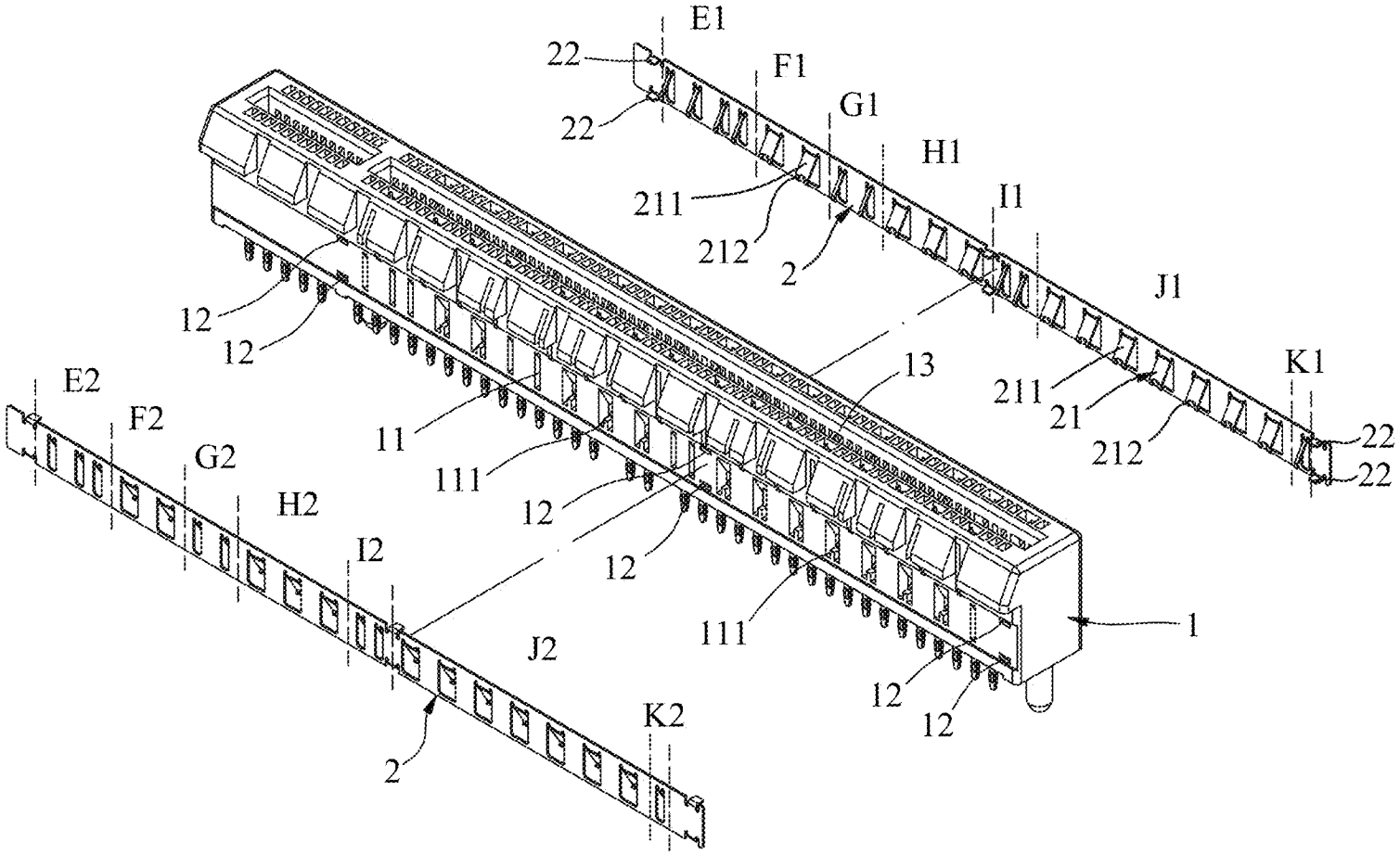
FIG. 13 is an arrangement diagram of the first elastic sheet and the second elastic sheet of the grounding sheet.

Referring to FIG. 13, the grounding sheet (2) of the connector can be modified to have the two grounding sheets (2) on a top and bottom sides thereof, and each of the two grounding sheets (2) has elastic conduction sheets (21), and the elastic conduction sheets (21) are divided into different groups. The grounding sheet (2) on the top side has a group (E1), a group (F1), a group (G1), a group (H1), a group (I1), a group (J1) and a group (K1), and the grounding sheet (2) on the bottom side has a group (E2), a group (F2), a group (G2), a group (H2), a group (I2), a group (J2) and a group (K2). Specifically, the group (E1) of the grounding sheet (2) on the top side comprises the four first elastic sheets (23), the group (F1) has the two second elastic sheets (24), the group (G1) comprises the two first elastic sheets (23), the group (H1) comprises the three second elastic sheets (24), the group (H) comprises the two first elastic sheets (23), the group (J1) comprises the seven the second elastic sheets (24), and the group (K1) comprises the first elastic sheet (23). The group (E2) of the grounding sheet (2) on the bottom side comprises the three first elastic sheets (23), the group (F2) comprises the two second elastic sheets (24), the group (G2) comprise the two first elastic sheets (23), the group (H2) comprises the three second elastic sheets (24), the group (I2) comprises the two first elastic sheets (23), the group (J2) comprises the seven second elastic sheets (24), the group (K2) comprises the first elastic sheet (23). Thus, the connector meets the specification of PCI-E, but the present disclosure is not limited to the arraignment.

Figure 14:
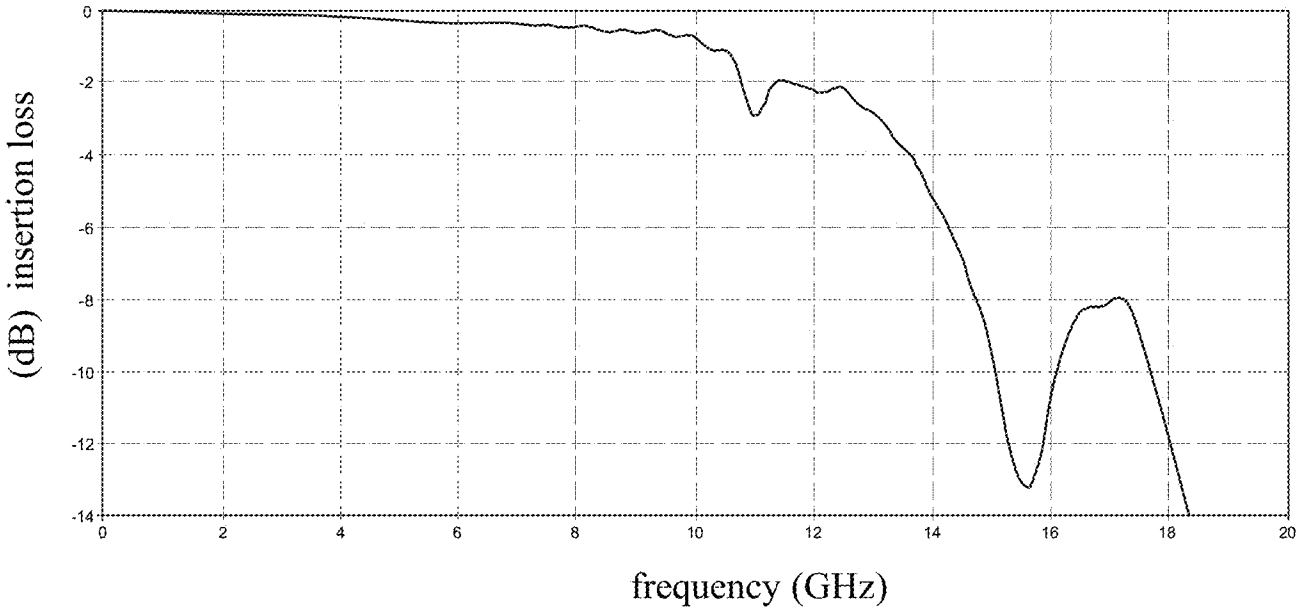
FIG. 14 is a diagram showing attenuation of the conventional grounding sheet at the high frequency.
Figure 15:
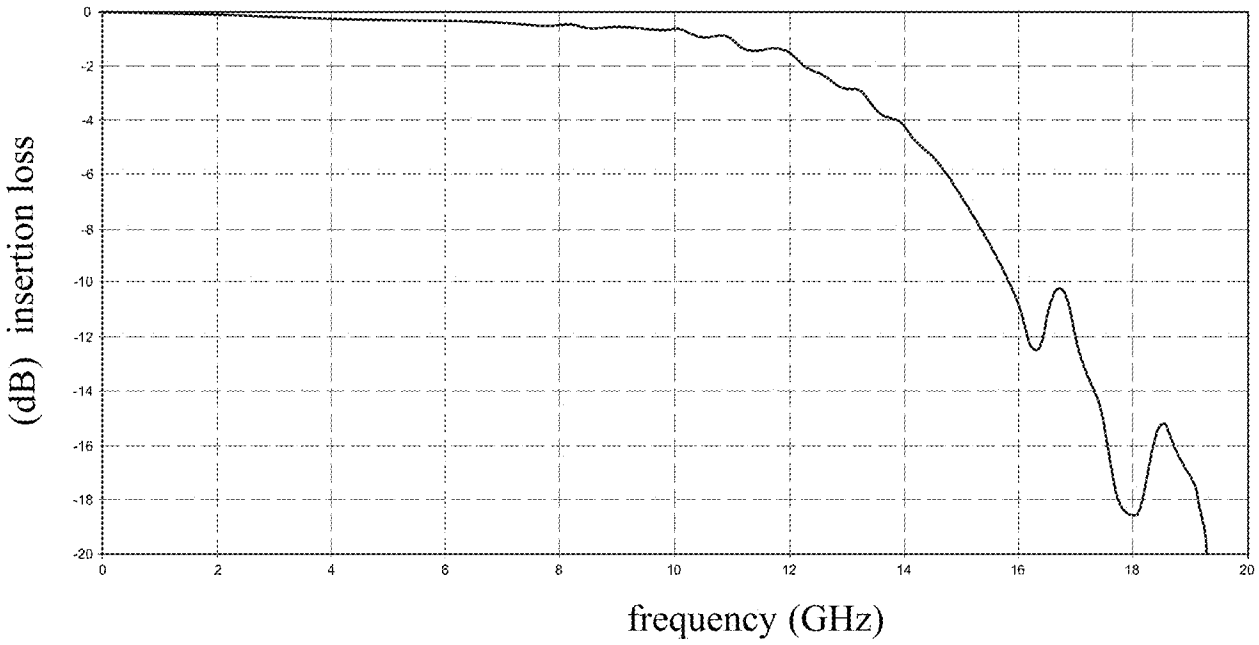
FIG. 15 is a diagram showing attenuation of the grounding sheet at the high frequency of the present disclosure.

Referring to FIG. 14 and FIG. 15, FIG. 14 is a diagram showing attenuation of the conventional grounding sheet at the high frequency, and FIG. 15 is a diagram showing attenuation of the grounding sheet at the high frequency of the present disclosure.

<Using a Network Analyzer to Measure the High Frequency Attenuation when the Second Elastic Sheet has Different Second Elastic Sheet Lengths>

Evaluation of High Frequency Attenuation

Test Method:

Take a connector by using the grounding sheet in the embodiment of the present disclosure and measure it in the operating frequency range of 1 GHz to 20 GHz through a network analyzer to obtain the results of FIG. 15. Take a connector by using the conventional grounding sheet and measure it in the operating frequency range of 1 GHz to 20 GHz through a network analyzer to obtain the results of FIG. 14.

Results and Discussion:

Referring to FIG. 14 and FIG. 15 at the same time, the vertical axis presents the insertion loss and its calculation unit is decibel (dB), and the horizontal axis presents the frequency and its calculation unit is gigahertz (GHz), wherein 0 dB insertion loss is observed a benchmark, it can be observed that the high-frequency attenuation simulation curve of the conventional grounding sheet has resonance at about 11 GHz, and the generation of resonance causes large insertion loss, i.e. the signal transmission is greatly affected by noise (as shown in FIG. 14). On contrary, by designing the lengths and widths of the first elastic sheet and the second elastic sheet to be fixed values, the connector by using the grounding sheet in the embodiment of the present disclosure improve the resonance at about 11 GHz of the conventional grounding sheet (as shown in FIG. 15), and thus the insertion loss is reduced and the better signal transmission quality can be obtained.

By using the above structure, the usage and technical results of the present disclosure can be described as follows.

1. The grounding sheet is integrated in one connector, the elastic conduction sheets contacts the terminal parts, and when the terminal parts receive and transmit signals, the elastic conduction sheets can be used to quickly conduct the noise outside, thus obtaining better stable signal transmission quality.

2. Not like the installation the conventional structure, each grounding sheet should be separately installed, the grounding sheet is integrated, and thus increasing the installation efficiency without the inconvenience of individual installation.

3. By using the structure of the present disclosure, the connector not only has a very simple shape, which greatly simplifies the manufacturing process and reduces the manufacturing cost, but also has an integrally formed rounding sheet design, which can quickly conducts the noise outside to improve the high speed signal transmission quality. The improved grounding sheet further greatly reduces the size of the connector, which increase the expansion of the circuit board or motherboard.

4. By using the structure of the present disclosure and by designing the lengths and widths of the first elastic sheet and the second elastic sheet to be fixed values, high frequency attenuation due to resonance of the grounding sheet can be eliminated.

To sum up, the grounding sheet and the connector disclosed by the above embodiments can achieve the mentioned technical results. The Applicant believes the grounding sheet and the connector of the present disclosure are not anticipated by prior art, and meet the provision of patentability in the patent act, and allowance of the present disclosure is requested respectfully.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

The invention claimed is:

1. A grounding sheet, comprising:

a body; and elastic conduction sheets being connected to the body;

wherein the elastic conduction sheet comprises a first elastic sheet and a second elastic sheet, each of the first elastic sheet and the second elastic sheet has a closed terminal, a floating arm, a connection arm, at least one free terminal and at least one end terminal, the closed terminal is connected to the body of the grounding sheet, the connection arm is connected to the closed terminal and the floating arm, the free terminal is connected to the floating arm, and the end terminal is connected to the free terminal and corresponds to the floating arm; the first elastic sheet has the merely one free terminal; the second elastic sheet has the two free terminals and the two end terminals, and the two free terminals of the second elastic sheet form a concave part therebetween; the closed terminal of the second elastic sheet and the connection arm of the second elastic sheet are connected at a first connection part, the first connection part and the concave part have a second elastic sheet length therebetween, and the second elastic sheet length is 1.840 mm.

2. The grounding sheet of claim 1, wherein each of the two end terminals of the second elastic sheet has a middle point, and the two middle points have a middle point distance being 1.000 mm therebetween.

3. The grounding sheet of claim 2, wherein the body has an elastic grounding sheet surface; the elastic grounding sheet surface and an outer wall of each of the floating arms have a first angle therebetween, the first angle is 15.75 degrees, the end terminal of each of the elastic conduction sheet and an inner wall of the floating arm have a second angle therebetween, and the second angle is 18 degrees.

4. The grounding sheet of claim 3, wherein the elastic grounding sheet surface and the inner wall of the floating arm have a third angle therebetween, and the third angle is larger than or equal to 0 degrees and less than or equal to 45 degrees.

5. The grounding sheet of claim 4, wherein the third angle of the second elastic sheet is 30.83 degrees, and a top part of the free terminal and the elastic grounding sheet surface have a second elastic sheet distance being 1.104 mm therebetween.

6. The grounding sheet of claim 5, wherein a first elastic sheet width of the first elastic sheet is 0.300 mm.

7. The grounding sheet of claim 6, wherein the first connection part and a bottom of the end terminal have a first elastic sheet length being 2.333 mm therebetween.

8. The grounding sheet of claim 7, wherein the closed terminal of the first elastic sheet and the body are connected at a second connection part, and the second connection part and the first connection part have a closed terminal length being 0.298 mm therebetween.

9. The grounding sheet of claim 8, wherein the concave part of the second elastic sheet and the bottom of the end terminal have an end terminal length being 0.565 mm therebetween.

10. The grounding sheet of claim 9, wherein the two end terminals of the second elastic sheet have a nearest end terminal width being 0.700 mm therebetween.

11. The grounding sheet of claim 1, wherein the grounding sheet is integrally formed by one metal sheet.

12. A connector, comprising:

a plastic housing having opened terminals and an inserting hole;

terminal parts installed in the plastic housing, wherein each of the terminal parts comprises an arc contacting portion and a welding portion, the arc contacting portion and the welding portion are connected to each other, a signal transmission path is formed from the arc contacting portion to the welding portion; and the at least one grounding sheet of claim 1, which is disposed in the plastic housing and corresponds to the opened terminal;

wherein the body is located on the plastic housing, the first elastic sheet and the second elastic sheet extends through the opened terminal to contact the terminal parts, and the first elastic sheet and the second elastic sheet contacts terminal part at a contacting part being located at a middle point of the signal transmission path.

13. The connector of claim 12, wherein the opened terminal has convex parts corresponding to the concave parts.

* * * * *